US012607183B2

(12) United States Patent
Wang et al.

(10) Patent No.: US 12,607,183 B2
(45) Date of Patent: Apr. 21, 2026

(54) SQUEEZING PERISTALTIC PUMP FOR CONTINUOUS TRANSFER, AND FLUID TRANSFER METHOD

(71) Applicant: Lead Fluid (Baoding) Intelligent Equipment Manufacturing Co., Ltd., Baoding (CN)

(72) Inventors: Ruipeng Wang, Baoding (CN); Qiang Wang, Baoding (CN); Jinfu Sun, Baoding (CN); Bin Zhang, Baoding (CN); Mingshuai Chen, Baoding (CN); Yanfeng Zhang, Baoding (CN)

(73) Assignee: Lead Fluid (Baoding) Intelligent Equipment Manufacturing Co., Ltd., Baoding (CN)

( * ) Notice: Subject to any disclaimer, the term of this patent is extended or adjusted under 35 U.S.C. 154(b) by 203 days.

(21) Appl. No.: 18/404,028

(22) Filed: Jan. 4, 2024

(65) Prior Publication Data

US 2024/0410352 A1 Dec. 12, 2024

(30) Foreign Application Priority Data

Jun. 12, 2023 (CN) ..... 202310688880.5

(51) Int. Cl.
*F04B 43/12* (2006.01)

(52) U.S. Cl.
CPC ..... *F04B 43/1223* (2013.01)

(58) Field of Classification Search
CPC ..... F04B 43/1223; F04B 43/12; F04B 17/03; F04B 53/00; F04B 53/006; F04B 7/0057
USPC ..... 417/474, 478, 479
See application file for complete search history.

(56) References Cited

U.S. PATENT DOCUMENTS

| | | | | |
|---|---|---|---|---|
| 4,648,812 | A | 3/1987 | Kobayashi et al. | |
| 8,029,253 | B2 * | 10/2011 | Rotem | F04B 43/12 417/478 |
| 2014/0161635 | A1 * | 6/2014 | Momeni | F04B 43/082 417/474 |
| 2016/0040662 | A1 | 2/2016 | Butterfiled et al. | |

FOREIGN PATENT DOCUMENTS

CN 104056322 A * 9/2014

* cited by examiner

*Primary Examiner* — Mark A Laurenzi
*Assistant Examiner* — Kelsey L Stanek
(74) *Attorney, Agent, or Firm* — NKL Law; Allen Xue

(57) ABSTRACT

Disclosed are a squeezing peristaltic pump for continuous transfer and a fluid transfer method. The squeezing peristaltic pump for continuous transfer includes: a housing, a transmission part, a pressing unit, and a limiting plate, the limiting plate being securely connected to the housing, a hose being disposed between the pressing unit and the limiting plate, the pressing unit being driven by the transmission part to move reciprocally to press the hose; wherein the pressing unit includes a squeezing device and a compensating device, the squeezing device and the compensating device being sequentially arranged along an output direction of fluid in the hose, in operation, the transmission part is configured to drive the squeezing device and the compensating device to alternately squeeze the hose.

14 Claims, 4 Drawing Sheets

SQUEEZING PERISTALTIC PUMP FOR CONTINUOUS TRANSFER, AND FLUID TRANSFER METHOD

FIELD

The disclosure relates to peristaltic pumps, and more particularly relates to a squeezing peristaltic pump for continuous transfer and a fluid transfer method.

BACKGROUND

A squeeze peristaltic pump is an apparatus for fluid pumping. It operates by using a drive system to bring a squeezing device to squeeze a hose, so that the hose is elastically deformed to form a negative pressure at a fluid inlet port of the hose, whereby fluid is drawn into the hose; with cooperation between the hose and the squeezing device, the fluid is pressure delivered in the hose and pumped out via a fluid outlet port of the hose.

In existing technologies, the squeezing device generally only comprises a fluid inlet shut-off valve, a squeezing working block, and a fluid discharge shut-off valve. Pumping of the fluid not only requires the squeezing working block to be relaxed to accumulate the fluid in the hose, but also requires the squeezing working block to squeeze the hose to pump the fluid out of the hose. As the hose relaxing and squeezing processes of the squeezing working block occur intermittently, the fluid cannot be pumped in a continuous manner.

SUMMARY

To overcome the technical problems noted supra, the disclosure provides a squeezing peristaltic pump for continuous transfer and a fluid transfer method. In a case that a squeezing device fails to continuously squeeze the hose, causing the fluid unable to be continuously pumped, a compensating device is provided in the squeeze peristaltic pump to compensate for squeezing the hose, and by reasonably setting respective activation timings of the squeezing device and the compensating device, the disclosure effectively solves fluid flow shutoff occurring when only the squeezing device is employed, thereby ensuring that the squeeze peristaltic pump pumps the fluid in a continuous, non-intermittent manner.

To achieve the objectives above, the disclosure provides specific technical solutions as follows:

In one aspect, embodiments of the disclosure further provide a squeezing peristaltic pump for continuous transfer, comprising: a housing a transmission part, a pressing unit, and a limiting plate. The limiting plate being securely connected to the housing. A hose being disposed between the pressing unit and the limiting plate, the pressing unit being driven by the transmission part to move reciprocally to press the hose; wherein the pressing unit comprises a squeezing device and a compensating device, the squeezing device and the compensating device being sequentially arranged along an output direction of fluid in the hose; in operation, the transmission part is configured to drive the squeezing device and the compensating device to alternately squeeze the hose.

Optionally, the transmission part is an eccentric transmission mechanism or a linear transmission mechanism.

Optionally, the transmission part sequentially comprises a fluid inlet shut-off cam, a fluid discharge shut-off cam, a working cam, and a compensating cam, the fluid inlet shut-off cam, the fluid discharge shut-off cam which are coaxially provided, a sum of a central angle of an upper-position section of the fluid inlet shut-off cam and a central angle of an upper-position section of the fluid discharge shut-off cam being 360°.

Optionally, the pressing unit comprises a block body or a rod piece.

Optionally, the pressing unit comprises a fluid inlet shut-off block, a fluid discharge shut-off block, a squeezing working block, and a compensating press block; and in operation, the fluid inlet shut-off cam is configured to drive the fluid inlet shut-off block, the fluid discharge shut-off cam is configured to drive the fluid discharge shut-off block, the working cam is configured to drive the squeezing working block, and the compensating cam is configured to drive the compensating press block.

Optionally, when the transmission part rotates, a start point of a return-travel section of the fluid discharge shut-off cam, a start point of a push-travel section of the working cam, and a start point of a return-travel section of the compensating cam are of the same time point.

Optionally, when the transmission part rotates, switchover between a push-travel section and the return-travel section of the fluid discharge shut-off cam is completed within the push-travel section of the working cam, and the start point of the return-travel section of the fluid discharge shut-off cam is the same to the start point of the return-travel section of the compensating cam.

Optionally, when the transmission part rotates, a start point of the push-travel section of the fluid discharge shut-off cam is earlier than an end point of the push-travel section of the working cam, an end point of the push-travel section of the fluid discharge shut-off cam is later than an end point of the push-travel section of the working cam, and the end point of the push-travel section of the fluid discharge shut-off cam is earlier than a start point of a push-travel section of the compensating cam.

Optionally, the housing comprises a front mounting plate, a rear mounting plate, and two side mounting plates, the two side mounting plates being oppositely disposed, the front mounting plate and the rear mounting plate being oppositely disposed, a notch for mounting the hose being provided at each of a top end of the front mounting plate and a top end of the rear mounting plate, the limiting plate being mounted at a side of the notch away from the squeezing unit.

Optionally, the hose, the transmission part, the squeezing device, and the compensating device are detachably mounted in the housing.

In another aspect, embodiments of the disclosure further provide a fluid transfer method, which is applied to the squeezing peristaltic pump for continuous transfer stated supra, wherein the squeezing device comprises a fluid inlet shut-off valve, a fluid discharge shut-off valve, and a squeezing working block, the fluid transfer method comprising:

when determining that the fluid inlet shut-off valve is closed, controlling the squeezing working block to press the hose;

when the squeezing working block stops squeezing the hose, controlling the fluid discharge shut-off valve to be closed;

before the fluid discharge shut-off valve is completely closed, controlling the compensating device to squeeze the hose; and after the fluid discharge shut-off valve is completely closed, controlling the fluid inlet shut-off valve to be opened.

Optionally, the method further comprises: when the squeezing working block starts pressing the hose, controlling the fluid discharge shut-off valve to be opened.

Optionally, at any time, at least one from the fluid inlet shut-off valve and the fluid discharge shut-off valve is in a closed state.

Optionally, the fluid transfer method is implemented by adjusting a cam shape of the transmission part.

Benefits

In the squeezing peristaltic pump for continuous transfer and the fluid transfer method utilizing the squeeze peristaltic pump according to the disclosure, a compensating device is additionally provided in the squeeze peristaltic pump to compensate for fluid flow shutoff occurring due to only a squeezing device being employed to squeeze the hose for fluid pumping. Cooperation between the compensating device and the squeezing device enables continuous, non-intermittent fluid pumping.

BRIEF DESCRIPTION OF THE DRAWINGS

To illustrate the technical solutions in embodiments of the disclosure or in conventional technologies more clearly, the drawings referred to will be briefly introduced infra. It is apparent that the drawings referred to hereinafter are only some embodiments of the disclosure, and to those skilled in the art, other drawings may also be derived from these drawings without exercise of inventive efforts.

REFERENCE NUMERALS

Figure 1:
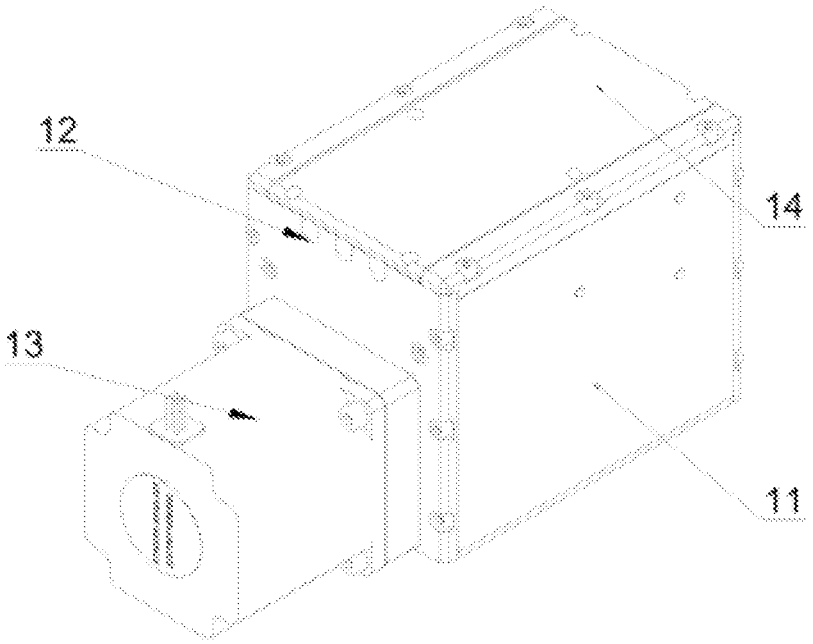
FIG. 1 is a stereoscopic structural diagram of a squeeze peristaltic pump according to embodiments of the disclosure.

1. fluid inlet shut-off block; 2. squeezing working block; 3. fluid discharge shut-off block; 4. compensating press block; 5. fluid inlet shut-off cam; 6. working cam; 7. fluid discharge shut-off cam; 8. compensating cam; 9. main shaft; 10. press block bearing; 11. housing; 12. notch; 13. electric motor; 14. limiting plate; 15. left side plate; 16. right side plate; 17. front mounting plate; 18. rear mounting plate; 19. sliding base; 20. thermally insulative element; 21. bearing hole; 23. sliding groove seat; 24. sliding groove; 25. hose.

DETAILED DESCRIPTION OF EMBODIMENTS

Hereinafter, the technical solutions in the embodiments of the disclosure will be described in a clear and comprehensive manner with reference to the accompanying drawings. Apparently, the example implementations described herein are only part of, rather than all of, the embodiments of the disclosure. All other implementations derived by a person of normal skill in the art based on these example implementations without exercise of inventive work would fall within the scope of protection of the embodiments of the disclosure.

As stated in the Background, an existing squeeze peristaltic pump generally comprises components such as a fluid inlet shut-off valve, a squeezing working block, and a fluid discharge shut-off valve. The fluid inlet shut-off valve, the squeezing working block, and the fluid discharge shut-off valve are arranged sequentially along an output direction of fluid in the hose. Before the fluid is pumped, the fluid inlet shut-off valve is in a closed state, the squeezing working block is in a relaxed state (without squeezing the hose), and the fluid discharge shut-off valve is in an opened state. In operation, the squeezing working block is first activated to squeeze the hose from where the squeezing working block is located, so that the hose is deformed under stress with its volume shrunk. When the squeezing working block reaches an extreme squeezing limit, the fluid discharge shut-off valve is activated to be closed (squeezing the hose till the hose is closed at the corresponding position). At this point, since the fluid inlet shut-off valve and the fluid discharge shut-off valve are both closed and the squeezing working block is squeezing the hose, a negative pressure is formed in the hose; then, if the fluid inlet shut-off valve is opened at this time, the negative pressure draws the fluid into the hose from the fluid inlet port of the hose along the output direction of the fluid in the hose. After the fluid discharge shut-off valve is closed, the fluid inlet shut-off valve is opened, and the squeezing working block resumes the state without squeezing the hose. At this time, as the hose resumes its shape, the fluid would be drawn into the hose from the fluid inlet port of the hose along the output direction of the fluid.

The negative pressure in the hose allows for the fluid to be drawn into the hose from the fluid inlet port of the hose along the output direction of the fluid and is accumulated in the hose. Afterwards, the fluid inlet shut-off valve squeezes the hose till the hose is closed, and then the fluid discharge shut-off valve is activated to be opened, allowing for the liquid to be pumped out of the hose along the output direction of the fluid.

The process described supra not only requires the squeezing working block to squeeze the hose for discharging the fluid, but also requires the squeezing working block to be relaxed to accumulate the fluid in the hose, so that the fluid pumping process in the hose is intermittent, inevitably causing flow shutoff of the fluid.

To overcome flow shutoff of the pumped fluid, the disclosure contemplates continuously squeezing, after the fluid discharge shut-off valve is closed, the hose in the fluid output direction of the hose. To achieve this function, the disclosure provides a compensating device downstream the squeezing device along the fluid output direction of the hose. After the fluid discharge shut-off valve is closed, the compensating device continues squeezing the hose to maintain continuous outflow of the fluid in the hose, thereby realizing continuous outflow of the fluid in the hose and preventing fluid flow shutoff.

A working structure of a continuous transfer squeeze pump is set as such: to enable the fluid inlet shut-off valve, the fluid discharge shut-off valve, the squeezing working block, and the compensating press block to move as contemplated, this solution employs a cam group as a drive structure, the cam group comprising a fluid inlet shut-off cam, a liquid discharge shut-off cam, a working cam, and a compensating cam, which are in one-to-one correspondence to the fluid inlet shut-off valve, the fluid discharge shut-off valve, the squeezing working block, and the compensating press block, respectively; the fluid inlet shut-off cam, the fluid discharge shut-off cam, the working cam, and the compensating cam being arranged sequentially along a main shaft and fixed thereon. The fluid inlet shut-off valve, the fluid discharge shut-off valve, the compressing working block, and the compensating press block are all formed of block bodies.

In addition, to further enhance coordination between the squeezing working block and the compensating device to improve continuous fluid discharge, it is needed to advance activation timing of the compensating device. Preferably, the compensating device may start squeezing the hose before the fluid discharge shut-off valve is completely closed, so that before the fluid discharge shut-off valve is closed to squeeze the fluid from where it is located along the fluid output direction, the compensating device has already been activated to squeeze and discharge the fluid; this eliminates a flow shutoff time gap between closing of the fluid discharge shut-off valve and hose-squeezing of the compensating device.

Moreover, the existing squeeze peristaltic pump has such a problem: since the fluid discharge shut-off valve therein is disposed very close to the outlet port of the hose in the fluid output direction, opening and closing of the fluid discharge shut-off valve have a direct impact on discharge of the fluid. As such, when the fluid inlet shut-off valve is closed and the fluid discharge shut-off valve is opened, the pressure in the hose would suction part of the fluid proximal to the fluid discharge shut-off valve back into the hose, thereby forming a fluid backflow, which hampers fluid pumping.

To overcome the backflow issue, the disclosure contemplates deferring opening time of the fluid discharge shut-off valve. In other words, the fluid discharge shut-off valve is opened after the squeezing working block is activated to squeeze the hose. If so, the fluid discharged by the squeezing working block's squeezing the hose compensates for the fluid backflow caused by opening of the fluid discharge shut-off valve, thereby mitigating the back-suction of the fluid in the hose, which may guarantee that the fluid is always outputted along the fluid output direction in the hose. Preferably, when opening the fluid discharge shut-off valve, the fluid discharge shut-off valve is preferably opened as slow as possible, so as to avoid abnormal situations such as fluid fluctuation caused by rapid reset of the fluid discharge shut-off valve.

To solve the problem and achieve the effect described supra, the disclosure provides a squeezing peristaltic pump for continuous transfer and a fluid continuous transfer method.

Hereinafter, specific structural components, inter-component connection relationships, and functions of respective components of a squeeze peristaltic pump according to the disclosure will be described in detail with reference to FIGS. 1 to 7.

The squeeze peristaltic pump according to the disclosure may comprise: a squeezing unit, a transmission part, a shell 11, an electric motor 13, a limiting plate 14, and at least one hose 25, wherein the squeezing unit comprises a squeezing device and a compensating device, the squeezing device comprising a fluid inlet shut-off block 1, a squeezing working block 2, and a fluid discharge shut-off block 3, the compensating device comprising a compensating press block 4; wherein the fluid inlet shut-off block 1 and the limiting plate 14 form the fluid inlet shut-off valve, the fluid discharge shut-off block 3 and the limiting plate 14 form the fluid discharge shut-off valve. The transmission part is an eccentric transmission mechanism or a linear transmission mechanism; in a case that the transmission part is a cam group, it may comprise a main shaft 9, a fluid inlet shut-off cam 5, a working cam 6, a fluid discharge shut-off cam 7, and a compensating cam 8; the fluid inlet shut-off cam 5, the working cam 6, the fluid discharge shut-off cam 7, and the compensating cam 8 are sequentially arranged and fixed on the main shaft 9.

Figure 2:
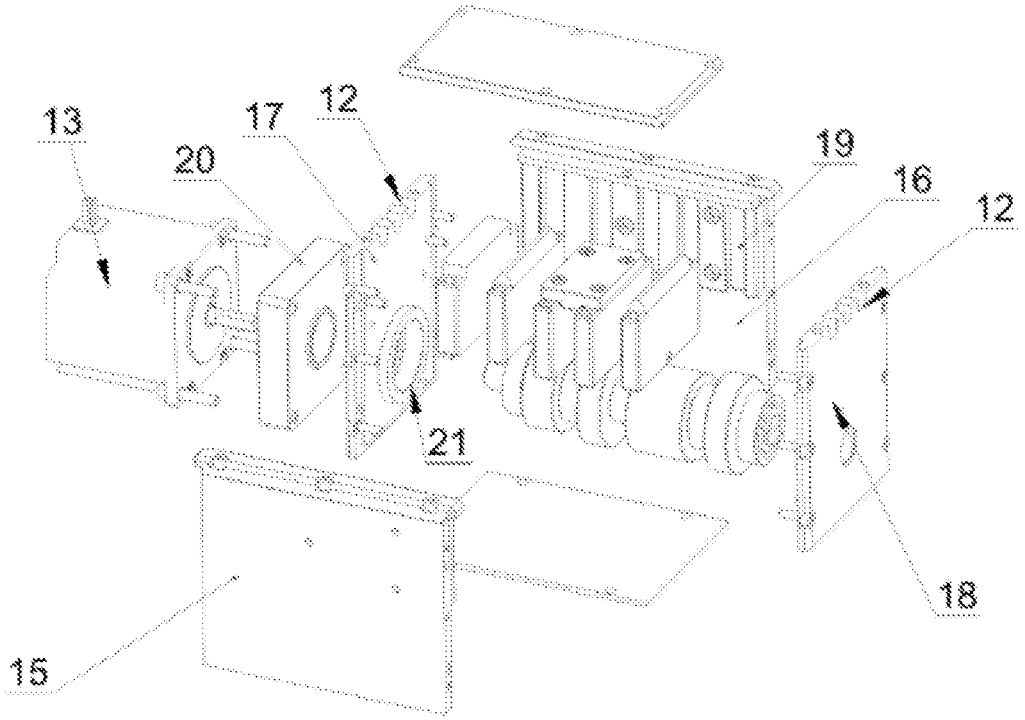
FIG. 2 is an exploded view of an overall structure of the squeeze peristaltic pump according to embodiments of the disclosure.

To mount the cam group, the valves, and the press block, the solution further comprises a housing, a body of the housing being of a hollow shell structure, a hollow space in the middle of the housing being configured to mount the transmission part and the squeezing unit, etc. As illustrated in FIG. 2, the housing 11 comprises a left side plate 15, a right side plate 16, a front mounting plate 17, and a rear mounting plate 18, the left side plate 15 and the right side plate 16 being oppositely disposed, and the front mounting plate 17 and the rear mounting plate 18 being oppositely disposed. It is noted that, the terms "left, right, front, rear" here only indicate opposite relationships, rather than actual directional relationships. In addition, as can be seen from FIG. 2, FIG. 3, and FIG. 5 in combination, the main shaft 9 passes through the front mounting plate 17 and the rear mounting plate 18 and is disposed inside the housing 11. Shaft holes 21 are provided at positions corresponding to the front mounting plate 17 and the rear mounting plate 17 to facilitate connection between the main shaft 9 and the housing 11.

To secure the hose, the solution further comprises a limiting plate 14, the limiting plate 14 serving as a foundation plane for the valve blocks to squeeze the hose and being detachably fixed on the housing 11. Notches 12 for mounting the hose are provided at corresponding positions above the front mounting plate 17 and the rear mounting plate 18. The notches 12 serve to place the hose 25. The limiting plate 14 is mounted at an upper portion of the housing 11 along the horizontal plane. In cooperation with setting of the notches 12, when the squeezing device and the compensating device inside the housing 11 squeeze the hose 25, the hose 25 can be caused to abut against a side of the limiting plate 14 facing the inside of the housing 11.

Additionally, as can be seen from FIG. 2, a thermally insulative element 20 is disposed between the electric motor 13 and the front mounting plate 17, configured to prevent the electric motor 13 from being overheated affecting operation of the squeezing device and the compensating device in the housing 11.

The electric motor 13 as a power source is mounted at a side of the housing 11, and an output shaft of the electric motor 13 is securely connected to the main shaft 9, so as to provide power for cam rotation.

In addition, as can be seen from the shapes of the squeezing device and the compensating device along the direction between the left side plate 15 and the right side plate 16, a sliding groove seat 23 is provided at each of the left side plate 15 and the right side plate 16 facing the inside of the housing 11, and a projected structure being slidable in the sliding groove seat 23 is provided at each of the two ends of the squeezing device and each of the two ends of the compensating press block in the compensating device.

Figure 3:
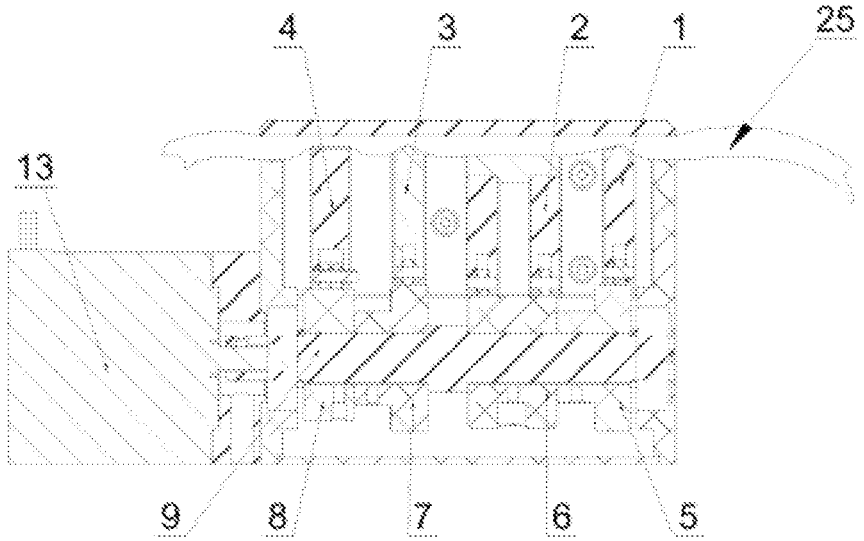
FIG. 3 is a sectional view of the overall structure of the squeeze peristaltic pump according to embodiments of the disclosure.

FIG. 3 is a sectional view of an overall structure of a squeeze peristaltic pump according to some embodiments of the disclosure. As can be seen from the figure, a fluid inlet shut-off cam 5, a working cam 6, a fluid discharge shut-off cam 7, and a compensating cam 8 are sequentially arranged on an outer surface of the main shaft 9 along the fluid output direction of the hose 25. Correspondingly, a fluid inlet shut-off block 1 is mounted at a position of the fluid inlet shut-off cam 5, a squeezing working block 2 is mounted at a position of the working cam 6, a fluid discharge shut-off block 3 is mounted at a position of the fluid discharge shut-off cam 7, and a compensating press block 4 is mounted at a position of the compensating cam 8. The electric motor 13 is mounted downstream the compensating press block 4 and the compensating cam 8 along the fluid output direction to supply power to the main shaft 9, further driving the fluid inlet shut-off cam 5, the working cam 6, the fluid discharge shut-off cam 7, and the compensating cam 8 to rotate, so that the fluid inlet shut-off block 1, the squeezing working block 2, the fluid discharge shut-off valve 3, and the compensating press block 4 corresponding to these cams are driven to squeeze the hose 25, respectively.

Figure 4:
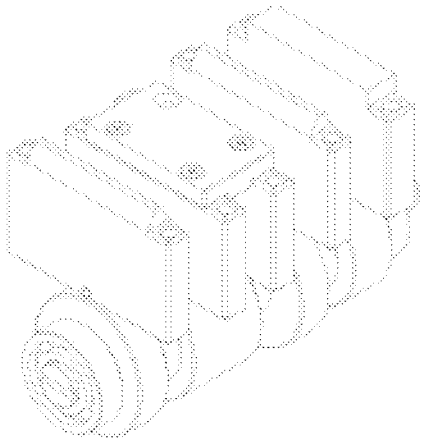
FIG. 4 is a stereoscopic structural diagram of a squeezing device and a compensating device according to embodiments of the disclosure.
Figure 5:
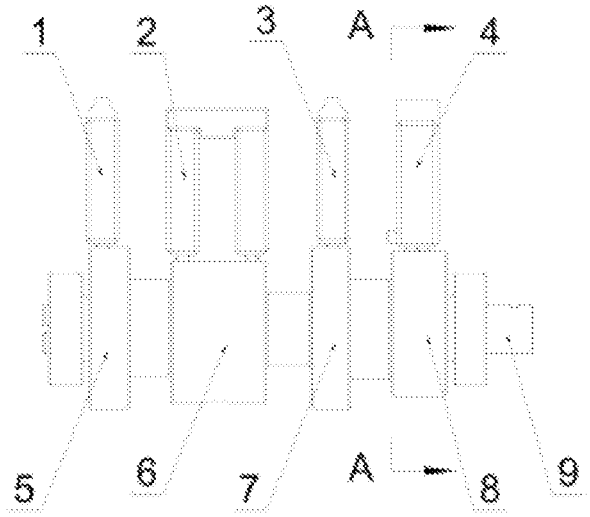
FIG. 5 is a side view of the squeezing device and the compensating device according to embodiments of the disclosure.
Figure 6:
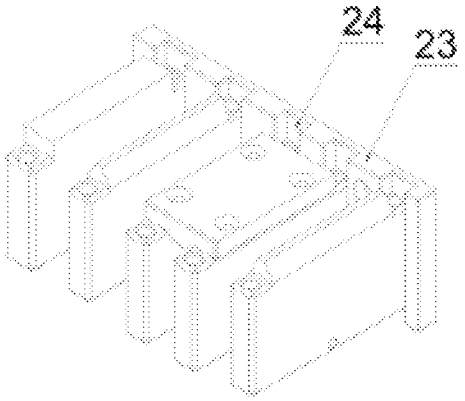
FIG. 6 is a schematic diagram illustrating how a squeezing unit and a compensating press block are fitted with a sliding base according to embodiments of the disclosure.

FIGS. 4 and 5 illustrate more details of positional relationships of the squeezing unit, the cam group, the compensating press block 4, and the compensating cam 8 with the main shaft 9. As can be seen from these figures, a fluid inlet shut-off cam 5, a working cam 6, a fluid discharge shut-off cam 7, and a compensating cam 8 are sequentially arranged on the outer surface of the main shaft 9 along the fluid output direction (the direction indicated by A and the arrow in FIG. 5) in the hose 5. The fluid inlet shut-off block 1 is provided on an outer surface of the fluid inlet shut-off cam 5, the squeezing working block 2 is provided on an outer surface of the working cam 6, the fluid discharge shut-off block 3 is provided on an outer surface of the fluid discharge shut-off cam 7, and the compensating press block 4 is provided on an outer surface of the compensating cam 8. Additionally, as can be seen with reference to FIG. 6, the fluid inlet shut-off block 1, the squeezing working block 2, the fluid discharge shut-off block 3, and the compensating press block 4 are not directly disposed in the housing 11 and so that they do not contact the inner side of the housing 11; instead, a sliding base 19 comprising a sliding groove seat 23 and the sliding groove 24 is provided at respective sides of the left side plate 15 and right side plate 16 of the housing 11 facing the inside of the housing 11, the sliding base 19 being configured to enhance movement stability of the valves and press block on respective outer surfaces of the cams. In this implementation, the projected structures at two ends of each of the fluid inlet shut-off block 1, the squeezing working block 2, the fluid discharge shut-off block 3, and the compensating press block 4 are adapted to the shapes of corresponding sliding groove 24 and slidably connected in respective sliding grooves 24 of the left side plate 15 and right side plate 16 to perform a sliding movement along a vertical direction, whereby the fluid inlet shut-off block 1, the squeezing working block 2, the fluid discharge shut-off block 3, and the compensating press block 4 may be moved by the fluid inlet shut-off cam 5, the working cam 6, the fluid discharge shut-off cam 7, and the compensating cam 8 to squeeze the hose 25. The sliding groove seats 23 are configured to space the sliding grooves 24 apart, avoiding the adjacent sliding grooves 24 from being too close to each other affecting sliding of the fluid inlet shut-off block 1, the squeezing working block 2, the fluid discharge shut-off block 3, and the compensating press block 4 along the vertical direction. Preferably, the sliding grooves 24 are made of an abrasion-resistant or self-lubricating material to enhance the abrasion-resistance and sliding performance of the sliding grooves 24.

Figure 7:
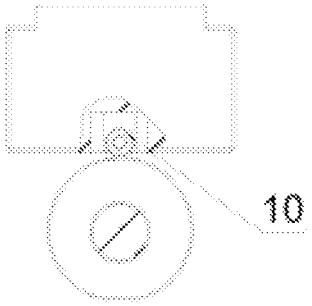
FIG. 7 is a positional schematic diagram of a bearing according to embodiments of the disclosure.

As can be seen from FIG. 7, in some embodiments of the disclosure, a press block bearing 10 is provided underneath each valve/block, i.e., providing a press block bearing 10 at a contact position between respective cams and corresponding valves/blocks, whereby friction between the cams and the valves/press blocks is reduced. In operation, the press bearing 10 serves as a cam follower, wherein the outer edge of the cam contacts the press block bearing 10 to bring the press block bearing 10 to rotate, thereby transmitting, via the press block bearing, a power driving the valves/blocks to move up and down. The press block bearing 10 reduces a contact area between respective cams and corresponding valves/press blocks; meanwhile, due to the inherent characteristics of cam transmission, the followers contact the cams by point or line, thereby maintaining contact with respective outer edges of the cams, so that movements of the valves and the press blocks are in more agreement with the movement law of cams, thereby avoiding movement distortion of the valves and press blocks. With the press block bearing as the contact point of each follower to contact with the corresponding cam, the contact area between the follower and the cam is reduced, so that the valves/blocks move in more agreement with the real movement law of cams.

On the basis of the squeeze peristaltic pump structure described supra, the disclosure further contemplates activation timing of the shut-off blocks and press blocks so as to effectively prevent shutoff of fluid flow. Here, movements of the fluid inlet shut-off block 1, the squeeze working block 2, the fluid discharge shut-off block 3, and the compensating press block 4 are driven by corresponding cams, and the movement states of corresponding cams are consistent with the movement states of the valves/press blocks; therefore, to ease the description, configuration of movement relationships between respective cams to realize continuous fluid pumping in the hose 25 will be analyzed from the perspective of movement states of the cams.

The outer-edge structure of each cam may be partitioned into a push-travel section, an upper-position section, a return-travel section, and a lower-position section, dependent on different functions. The upper-position section refers to a circular segment of the cam at the maximum diameter position, the lower-position section refers to a circular segment of the cam at the minimum diameter position, the push-travel section refers to a circular segment between the lower-level section and the upper-position section, and the return-travel section refers to a circular segment from the upper-position section to the lower-position section. In the disclosure, the push-travel section, the upper-position section, the return-travel section, and the lower-position section of the cam correspond to respective sections of the cam from rotating to drive the corresponding valve/press block to squeeze tightly to close the hose 25 till rotating to drive the valve/press block to be relaxed and return to the initial position.

Additionally, it is further needed to ensure alternate working of the fluid inlet shut-off block 1 and the fluid discharge shut-off block 3 and to ensure any of the fluid inlet shut-off block 1 and the fluid discharge shut-off block 3 to maintain a closed state at any time, thereby ensuring that the pump body area where the hose 25 is located is shut off. Accordingly, the sum of central angles of the upper-position sections of the fluid inlet shut-off cam 5 and the fluid discharge shut-off cam 7 should be 360°. In addition, the sum of central angles of non-overlapping portions of the push-travel sections of the working cam 6, the compensating cam 8, and the fluid discharge shut-off cam 7 is 360°.

From the perspective of fluid discharge, in order to discharge the fluid along the fluid output direction in the hose 25 using the squeezing working block 2, the squeezing start time point of the squeezing working block 2 should be set to be later than the fluid inlet shut-off block 1's squeezing and closing the hose 25. At this point, since the fluid inlet shut-off block 1 is closed, when the squeezing working block 2 squeezes the hose 25, the fluid in the hose 25 is surely discharged along the fluid output direction. In addition, to discharge the fluid along the fluid output direction in the hose 25 using the compensating press block 4, the squeezing start time point of the compensating press block 4 should be set to be later than the fluid discharge shut-off block 3's squeezing and closing the hose 25. At this point, since the fluid discharge shut-off block 3 has been closed, when the hose 25 is squeezed by the compensating press block 4, the fluid in the hose 25 is surely discharged along the fluid output direction.

To prevent the compensating press block from causing back-suction in the hose, activation of the return-travel section of the compensating press block should be later than start of the push-travel section of the squeezing working block.

Additionally, since the operating position corresponding to the compensating cam is in direct communication with the hose outlet port direction, movement of the compensating cam can directly influence a liquid amount outputted by the hose; when the compressing press block is reset, since the hose resumes its shape, back-suction inevitably occurs, forming a reverse traffic. To prevent this back-suction, a start time point of the return-travel section of the compensating cam 8 is set to be later than a start time point of the push-travel section of the working cam 6. In this way, the squeezing working block 2 first squeezes the hose 25 to discharge the fluid along the fluid output direction in the hose 25, and then starts relaxing the compensating press block 4 so as to leverage the fluid generated by the squeezing action of the squeezing working block 2 to counteract the fluid back-suction caused by relaxation of the compensating press block 4, thereby effectively preventing fluid flow shutoff if there only exists fluid back-suction.

In addition, continuous fluid output may also be effectively realized through cooperation between the working cam 6, the fluid discharge shut-off cam 7, and the compensating cam 8. A specific implementation manner is as such: setting the activation timing of the cam based on activation of the fluid discharge shut-off cam 7. A start time point of the return-travel section of the fluid discharge shut-off cam 7 is set to be the same to a start time point of the push-travel section of the working cam 6 and a start time point of the return-travel section of the compensating cam 8. Meanwhile, to prevent fluid back-suction, respective durations of the push-travel section and the return-travel section of the fluid discharge shut-off cam 7 are set to be shorter than a duration of the push-travel section of the working cam 6, and switchover between the push-travel section and the return-travel section of the fluid discharge shut-off cam 7 should be completed within the push-travel section of the working cam 6. Moreover, in the disclosure, the start time point of the return-travel section of the fluid discharge shut-off cam 7 is set to be the same to the start time point of the return-travel section of the compensating cam 8, so that the fluid along the fluid output direction as generated when the squeezing working block 2 squeezes the hose 25 counteracts the fluid suctioned back when the compensating press block 4 relaxes the hose 25. In addition, in the disclosure, the start time point of the push-travel section of the fluid discharge shut-off cam 7 is set to be earlier than the end time point of the push-travel section of the working cam 6, the end time point of the push-travel section of the fluid discharge shut-off cam 7 is set to be later than the end time point of the push-travel section of the working cam 6, and the end time point of the push-travel section of the fluid discharge shut-off cam 7 is set to be earlier than the start time point of the push-travel section of the compensating cam 8. In addition, to realize discharge of the fluid along the fluid output direction in the hose 25, the start time point of the push-travel section of the compensating cam 8 is set to be the same to the end time point of the push-travel section of the fluid discharge shut-off cam 7, and the end time point of the push-travel section of the fluid discharge shut-off cam 7 is set to be the same to the start time point of the return-travel section of the working cam 6.

The structural design of the squeeze peristaltic pump and the cooperation timing design between respective cams in the squeeze peristaltic pump described supra may effectively overcome the fluid flow shut-off problem occurring when only the squeezing device is conventionally used to squeeze the hose 25 to pump fluid; with mutual cooperation between the structural components described supra, continuous, non-interruptive fluid pumping is realized.

Based on the squeezing peristaltic pump for continuous transfer described supra, embodiments of the disclosure further provide a fluid transfer method, wherein the squeezing device comprises a fluid inlet shut-off valve, a fluid discharge shut-off valve, and a squeezing working block, the method comprising:

controlling, when determining that the fluid inlet shut-off valve is closed, the squeezing working block to press the hose;

controlling, when the squeezing working block stops squeezing the hose, the fluid discharge shut-off valve to be closed;

controlling, before the fluid discharge shut-off valve is completely closed, the compensating device to squeeze the hose; and controlling, after the fluid discharge shut-off valve is completely closed, the fluid inlet shut-off valve and the squeezing working block to be opened.

In one or some embodiments, the method may further comprise: controlling, when the squeezing working block starts pressing the hose, the fluid discharge shut-off valve to be opened;

In one or some embodiments, at least one of the fluid inlet shut-off valve and the fluid discharge shut-off valve is in a closed state at any time.

In one or some embodiments, the fluid transfer method is implemented by adjusting cam shapes of the transmission part.

The various example embodiments of the disclosure have been described in a progressive manner, and each example embodiment focuses on a difference from other example embodiments; same or similar portions between respective example embodiments may be referenced with each other.

The principle and implementation manners of the disclosure have been described above via specific examples; illustration of the example embodiments is only intended for facilitating understanding of the apparatus and core idea of the disclosure. To a person of normal skill in the art, specific implementation manners and application scope of the idea of the disclosure are subjected to alterations. Therefore, the contents hereof shall not be interpreted as limitations to the disclosure.

The invention claimed is:

1. A squeezing peristaltic pump for continuous transfer, comprising:

a housing;

a transmission part;

a pressing unit;

a limiting plate securely connected to the housing; and a hose disposed between the pressing unit and the limiting plate;

wherein the pressing unit is driven by the transmission part to move reciprocally to press the hose, and comprises a squeezing part and a compensating part which are sequentially arranged along an output direction of fluid in the hose;

wherein the squeezing part comprises a fluid inlet shut-off block, a fluid discharge shut-off block, and a squeezing working block, the fluid inlet shut-off block and the limiting plate form a fluid inlet shut-off valve, the fluid discharge shut-off block and the limiting plate form a fluid discharge shut-off valve, and the compensating part comprises a compensating press block;

wherein the transmission part comprises a fluid inlet shut-off cam, a fluid discharge shut-off cam, a working cam, and a compensating cam which are coaxially provided, a sum of a central angle of an upper-position section of the fluid inlet shut-off cam and a central angle of an upper-position section of the fluid discharge shut-off cam being 360°;

wherein in operation, the transmission part is configured to drive the squeezing part and the compensating part to alternately squeeze the hose.

2. The squeezing peristaltic pump for continuous transfer according to claim 1, wherein the transmission part is an eccentric transmission mechanism or a linear transmission mechanism.

3. The squeezing peristaltic pump for continuous transfer according to claim 1, wherein the pressing unit comprises a block body or a rod piece.

4. The squeezing peristaltic pump for continuous transfer according to claim 1, wherein in operation, the fluid inlet shut-off cam is configured to drive the fluid inlet shut-off block, the fluid discharge shut-off cam is configured to drive the fluid discharge shut-off block, the working cam is configured to drive the squeezing working block, and the compensating cam is configured to drive the compensating press block.

5. The squeezing peristaltic pump for continuous transfer according to claim 4, wherein when the transmission part rotates, a start point of a return-travel section of the fluid discharge shut-off cam, a start point of a push-travel section of the working cam, and a start point of a return-travel section of the compensating cam are of the same time point.

6. The squeezing peristaltic pump for continuous transfer according to claim 4, wherein when the transmission part rotates, switchover between a push-travel section and a return-travel section of the fluid discharge shut-off cam is completed within a push-travel section of the working cam, and a start point of the return-travel section of the fluid discharge shut-off cam is the same as a start point of a return-travel section of the compensating cam.

7. The squeezing peristaltic pump for continuous transfer according to claim 4, wherein when the transmission part rotates, a start point of a push-travel section of the fluid discharge shut-off cam is earlier than an end point of a push-travel section of the working cam, an end point of the push-travel section of the fluid discharge shut-off cam is later than the end point of the push-travel section of the working cam, and the end point of the push-travel section of the fluid discharge shut-off cam is earlier than a start point of a push-travel section of the compensating cam.

8. The squeezing peristaltic pump for continuous transfer according to claim 1, wherein the housing comprises a front mounting plate, a rear mounting plate, and two side mounting plates, the two side mounting plates being oppositely disposed, the front mounting plate and the rear mounting plate being oppositely disposed, a notch for mounting the hose being provided at each of a top end of the front mounting plate and a top end of the rear mounting plate, the limiting plate being mounted at a side of the notch away from the pressing unit.

9. The squeezing peristaltic pump for continuous transfer according to claim 1, wherein the hose, the transmission part, the squeezing part, and the compensating part are detachably mounted in the housing.

10. A fluid transfer method, which is applied to a squeezing peristaltic pump for continuous transfer, the squeezing peristaltic pump for continuous transfer comprising:

a housing;

a transmission part;

a pressing unit;

a limiting plate securely connected to the housing; and a hose disposed between the pressing unit and the limiting plate;

wherein the pressing unit is driven by the transmission part to move reciprocally to press the hose, and comprises a squeezing part and a compensating part which are sequentially arranged along an output direction of fluid in the hose;

wherein the squeezing part comprises a fluid inlet shut-off block, a fluid discharge shut-off block, and a squeezing working block, the fluid inlet shut-off block and the limiting plate form a fluid inlet shut-off valve, the fluid discharge shut-off block and the limiting plate form a fluid discharge shut-off valve, and the compensating part comprises a compensating press block;

wherein the transmission part comprises a fluid inlet shut-off cam, a fluid discharge shut-off cam, a working cam, and a compensating cam which are coaxially provided, a sum of a central angle of an upper-position section of the fluid inlet shut-off cam and a central angle of an upper-position section of the fluid discharge shut-off cam being 360°;

wherein in operation, the transmission part is configured to drive the squeezing part and the compensating part to alternately squeeze the hose, the fluid transfer method comprising:

when the fluid inlet shut-off valve is closed, controlling the squeezing working block to press the hose;

when the squeezing working block stops squeezing the hose, controlling the fluid discharge shut-off valve to be closed;

before the fluid discharge shut-off valve is completely closed, controlling the compensating part to squeeze the hose; and after the fluid discharge shut-off valve is completely closed, controlling the fluid inlet shut-off valve and the squeezing working block to be opened.

11. The fluid transfer method according to claim 10, further comprising: when the squeezing working block starts pressing the hose, controlling the fluid discharge shut-off valve to be opened.

12. The fluid transfer method according to claim 10, wherein at any time, at least one from the fluid inlet shut-off valve and the fluid discharge shut-off valve is in a closed state.

13. The fluid transfer method according to claim 10, wherein the fluid transfer method is implemented by adjusting a cam shape of the transmission part.

14. A squeezing peristaltic pump for continuous transfer, comprising:

a housing;

a transmission part;

a pressing unit;

a limiting plate securely connected to the housing; and a hose disposed between the pressing unit and the limiting plate;

wherein the pressing unit is driven by the transmission part to move reciprocally to press the hose, and comprises a squeezing part and a compensating part which are sequentially arranged along an output direction of fluid in the hose;

wherein the housing comprises a front mounting plate, a rear mounting plate, and two side mounting plates, the two side mounting plates being oppositely disposed, the front mounting plate and the rear mounting plate being oppositely disposed, a notch for mounting the hose being provided at each of a top end of the front mounting plate and a top end of the rear mounting plate mounted at a side of the notch away from the pressing unit;

wherein in operation, the transmission part is configured to drive the squeezing part and the compensating part to alternately squeeze the hose.

* * * * *